US005533592A

United States Patent [19]

Lamoureux

[11] Patent Number: 5,533,592

[45] Date of Patent: Jul. 9, 1996

[54] EXPANDABLE SCAFFOLD FOR HOPPER

[76] Inventor: Laurent J. Lamoureux, Box 8, Group 25, R.R. #2, Ste. Anne, Manitoba, Canada, R0A 1R0

[21] Appl. No.: 348,842

[22] Filed: Nov. 28, 1994

[51] Int. Cl.[6] ..... E04G 3/10

[52] U.S. Cl. ..... 182/128; 182/152; 182/150

[58] Field of Search ..... 182/128, 142, 182/150, 152

[56] References Cited

U.S. PATENT DOCUMENTS

| | | | |
|---|---|---|---|
| 1,090,856 | 3/1914 | Johnson . | |
| 2,221,133 | 11/1940 | Gladville . | |
| 3,080,941 | 3/1963 | Fuller | 182/128 |
| 3,166,154 | 1/1965 | Titzel . | |
| 3,454,133 | 7/1969 | Gregord . | |
| 3,994,365 | 11/1976 | Petermann et al. . | |
| 4,058,184 | 11/1977 | Stuart | 182/128 |
| 4,095,670 | 6/1978 | Martin . | |
| 4,168,052 | 9/1979 | Calderaro . | |
| 5,183,629 | 2/1993 | Batistoni | 182/128 |

*Primary Examiner*—Alvin C. Chin-Shue
*Attorney, Agent, or Firm*—Adrian D. Battison; Murray E. Thrift

[57] ABSTRACT

This invention relates to an expandable scaffold for use with hoppers and the like which can fold up to pass through a narrow or confined opening. The scaffold can be expanded in the interior of the hopper thereby providing the operator with a place to stand while working. The scaffold comprises attachment means for attaching the scaffold at a top end to a hoist or crane, an articulated frame including a plurality of bars joined together by pivot connection means, folding means connected to the attachment means at one end and to the articulated frame at an other end, scaffold flooring mounted on the articulated frame for supporting an individual, and a plurality of suspension means.

20 Claims, 5 Drawing Sheets

EXPANDABLE SCAFFOLD FOR HOPPER

BACKGROUND OF THE INVENTION

This invention relates to an expandable scaffold for use with hoppers and the like. In many applications hoppers are used for transportation and storage of fluid and fluid like materials. Many of these hoppers have a narrow or confined opening at the top to allow passage of the fluid material inside and then open outwards into a larger area beneath the opening. These hoppers need periodic maintenance and repair often requiring that an individual enter the hopper to work on the interior walls. It will be appreciated that working inside the hopper is very difficult and in many cases a scaffold is needed for the operator to be able stand in a suitable location when working on the interior walls.

Various scaffolds for use in vessels with restricted openings and other folding devices are shown in the prior art.

G. Johnson shows in U.S. Pat. No. 1,090,856, Mar. 24, 1914 shows a scaffold for building shells of blast furnaces or other tubular furnaces and the like. It has a hollow cylindrical central guide support which is supported by a large overhead hoist or pulley. A large cage extends outwards from the central support for a workman to stand upon. This device is not expandable and would not fit through the restricted opening in the top of a hopper.

Gladville shows in U.S. Pat. No. 2,221,133, Nov. 12, 1949 a scaffold for use with a cylindrical structure. This device is for use with a structure having a large opening at the top and would not be usable with a hopper having a restricted opening.

J. M. Titzel shows in U.S. Pat. No. 3,166154, Jan. 19, 1965 a portable scaffold work tower. The work tower is a very large self supporting tower with fixed arms at its base for use in steel making vessels. The tower is lowered into the vessel by a crane and supported on the base of the vessel by feet. The tower has a cage for lowering the workman into the vessel and outwardly extending arms at its base to support the workman.

T. Gregord shows in U.S. Pat. No. 3,454,133, Jul. 8, 1969 a portable work tower for use in vessels having limited clearance. The work tower is a very large self-supporting tower with fixed arms at its base for use in steel making vessels. The tower is lowered into the vessel in pieces and assembled in place.

Martin shows in U.S. Pat. No. 4,095,670, Jun. 20, 1978 a foldable platform for raise drilling. The platform is for lowering into a predrilled mine shaft for supporting workmen who are widening the shaft. This platform is very large and is supported by a large overhead crane. It has a central tower and foldable support arms which project out from the bottom end of the tower.

Peterman shows in U.S. Pat. No. 3,994,365, Nov. 30, 1976 an apparatus for positioning a person within a very large container tank. The apparatus is supported by a large overhead crane and is lowered into the tank through a restricted opening. The apparatus includes a central column having arms pivotally fixed to it at one end of the arms is a cage for supporting a man and at the other a counter weight.

Although these scaffolds are expandable all are either very large, expensive, require assembly with in the vessel, or would not work with a rail hopper or the like.

Calderaro shows in U.S. Pat. No. 4,168,052, Sep. 18, 1979 a foldable bearer structure for inner mould placement for use with concrete moulds and the like. Although foldable it would not be usable for the purpose desired within a hopper since it would require several men to expand it after lowering it in place within the hopper which is not practical, and is not be usable to support a man.

A scaffold is needed therefore which can fold up to pass through a narrow or confined opening and can then readily expand into a position in the interior of the hopper thereby providing the operator with a place to stand while working.

SUMMARY OF THE INVENTION

It is an object of the present invention therefore to provide a scaffold of the type which can fold up to pass through a narrow or confined opening and can then readily expand into a position in the interior of the hopper thereby providing the operator with a place to stand while working.

According to the present invention there is provided an expandable scaffold of the type for use with a hopper having a narrow opening in the top and which opens out into a larger area inside wherein the scaffold comprises: attachment means for attaching the scaffold at a top end to a hoist or crane or the like for raising and lowering the scaffold; an articulated frame including a plurality of bars joined together by a first pivot connection means such that pivoting of the bars may occur about a vertical axis, and by a second pivot connection means such that pivoting of the bars may occur about an axis inclined between the vertical and horizontal axes, wherein the articulated frame may be oriented in a first position such that the bars are arranged in a vertical orientation and a second position such that the bars are arranged in a horizontal position; folding means connected to the attachment means at one end and to the second pivot connection means on the articulated frame at an other end arranged such that the folding means when actuated move the articulated frame between the first and second positions; scaffold flooring mounted on the articulated frame for supporting an individual; a plurality of suspension means each being removably and reengagebly connected at one end to the narrow opening of the vessel and each being connected at the other end near one of the first pivot connection means on the articulated frame.

Preferably the articulated frame comprises eight bars arranged in four pairs such that each pair of bars is joined together at adjacent ends by second pivoting means and that each pair is joined to another pair at its free ends by first pivoting means.

Preferably the bars comprise angle iron sections each having a horizontal and a vertical flange such that when the scaffold is in the second position the bars are arranged with a horizontal face oriented upwards and a vertical face oriented inwards towards a center.

Preferably the bars when the scaffold is in the second position are arranged to form a generally square periphery.

Preferably the edges of the horizontal and vertical flanges engage each other when the scaffold is in the second position thereby preventing downward movement past the second position.

Preferably the attachment means comprise a substantially flat attachment plate oriented generally in the horizontal plane having a releasable and reengageable connection means on a top side, pivot connection means on a bottom side, and loops for receiving hooks spaced around the periphery.

Preferably the releasable and reengageable connection means comprise an inverted U member for engaging a hooking means on a crane or hoist or the like.

Preferably the pivot connection means comprise a pin arrangement for rotation about a horizontal axis.

Preferably the pivot connection means are spaced around the periphery of the plate at intervals of 90 degrees.

Preferably the first pivot connection means comprise a hinge fixed to an outer free edge of the horizontal face and a bottom free edge of the vertical face, arranged such that one hinge plate is fixed near its top edge to a first bar and a second hinge plate is fixed near its top to a second bar, and a hinge pin is oriented to allow pivot movement about an axis lying between the vertical and horizontal planes and such that a top of each hinge plate is fixed to a bottom surface near an outside free edge of the horizontal flange and a bottom of each hinge plate is fixed to an outside surface near the bottom of the vertical flange.

Preferably the axis lying between the vertical and horizontal planes is at 45 degrees to the horizontal flange.

Preferably the second pivot connection means comprise a hinge fixed on an inner vertical face of the vertical flange of one free end on each of a pair of bars, arranged such that one hinge plate is fixed to the vertical face of one pair of bars, a second hinge plate is fixed to the vertical face of a second pair of bars, and a hinge pin is oriented to allow pivotal movement about a vertical axis when the articulated frame is in the second position.

Preferably each suspension means comprise a chain having a hook at one end and being fixed to the articulated frame near one of the first pivotal connection means at another end.

Preferably the folding means comprise elongate arm members.

The elongate arm members comprise an elongate member having fixed at one of its ends a member for engaging one of the pin arrangements on the attachment plate, a bend at the end opposite, and at the end with the bend a hollow cylindrical member for engaging around the hinge pin of one of the second pivot connection means.

Preferably the elongate arm members include a pair of support members fixed to opposing sides of the arm which lie generally horizontally when the scaffold is in the second position.

Preferably the lateral securing means comprising an elongate bar having a stopper member at one end for engaging the a wall, a pair of vertical members having slidable connection means for connecting the elongate bar to the elongate arms and spacing it therefrom, such that when the scaffold is in the second position the vertical members project downwards and the elongate bar lies generally horizontally with the stopper positioned outwards such that the elongate bar may be slidably positioned to pass under the articulated frame with the stopper end positioned to contact a wall.

Preferably the scaffold flooring extends form the outer edge of the horizontal bars inwards to the center of the scaffold.

Preferably the scaffold flooring comprises a plurality of individual flooring sections pivotally connected such that the flooring may be folded up upon itself and unfolded to cover an area defined by a periphery formed by the articulating frame.

Preferably there are four scaffold flooring sections each one being fixed on one edge to an outer edge of the articulated frame for covering one quadrant of the articulating frame, such that when in the folded position each section lies along an adjacent bar of the articulated frame and when in the unfolded position it is supported on two sides by the bars of the articulated frame and the other two sides by the fins on the arms covering the area therebetween.

One embodiment of the invention will now be described in conjunction with the accompanying drawings in which:

DESCRIPTION OF THE DRAWINGS

In the drawings like characters of reference indicate corresponding parts in the different figures.

DETAILED DESCRIPTION

Figure 1:
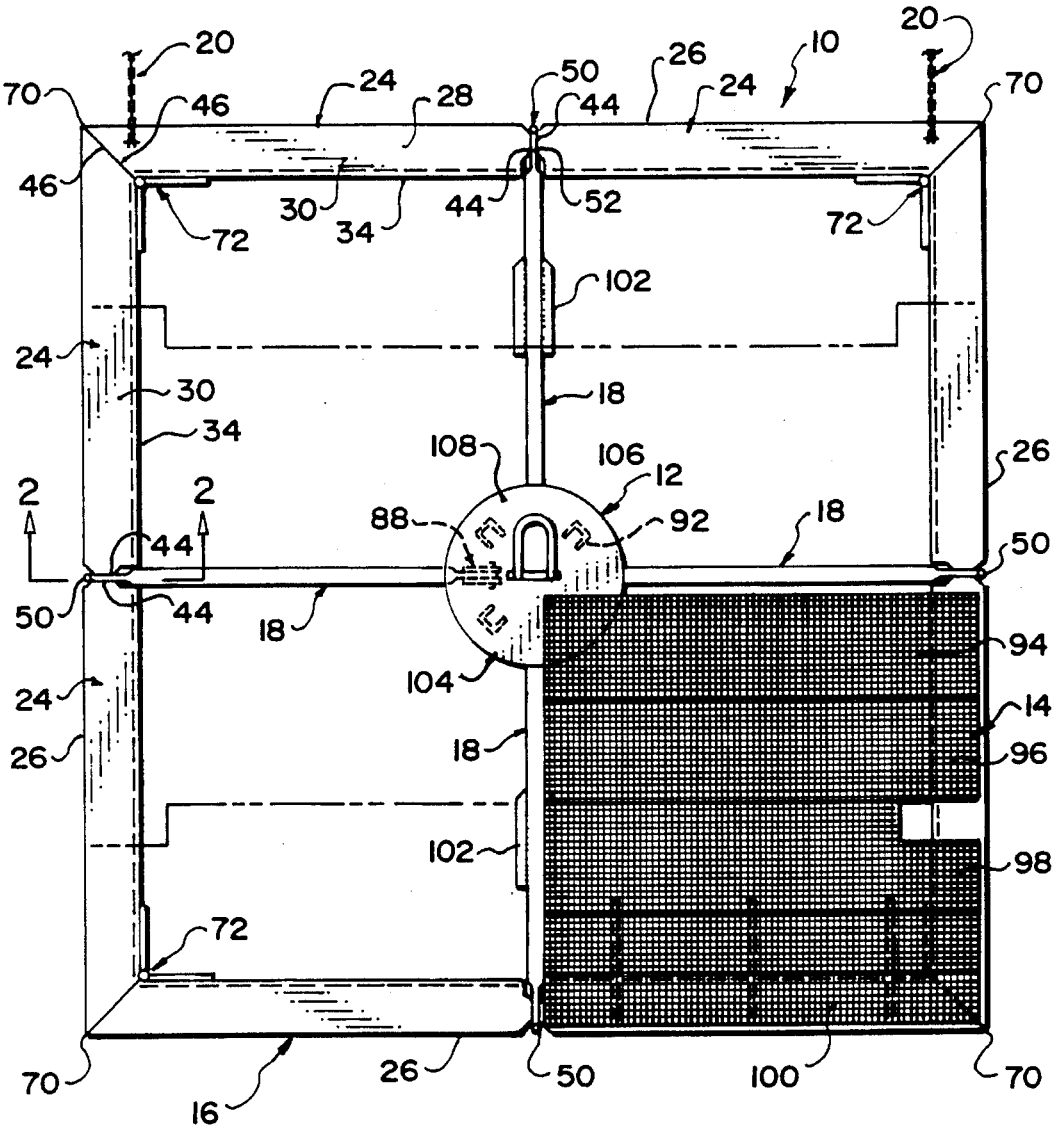
FIG. 1 is a top plan view of the expandable scaffold in the expanded horizontal position.

The expandable scaffold will be described below in its expanded horizontal position as is shown in FIG. 1. The scaffold shown generally at 10 comprises an attachment plate 12, scaffold flooring 14, an articulated frame 16, elongate arms 18, a plurality of support chains 20.

Figure 2:
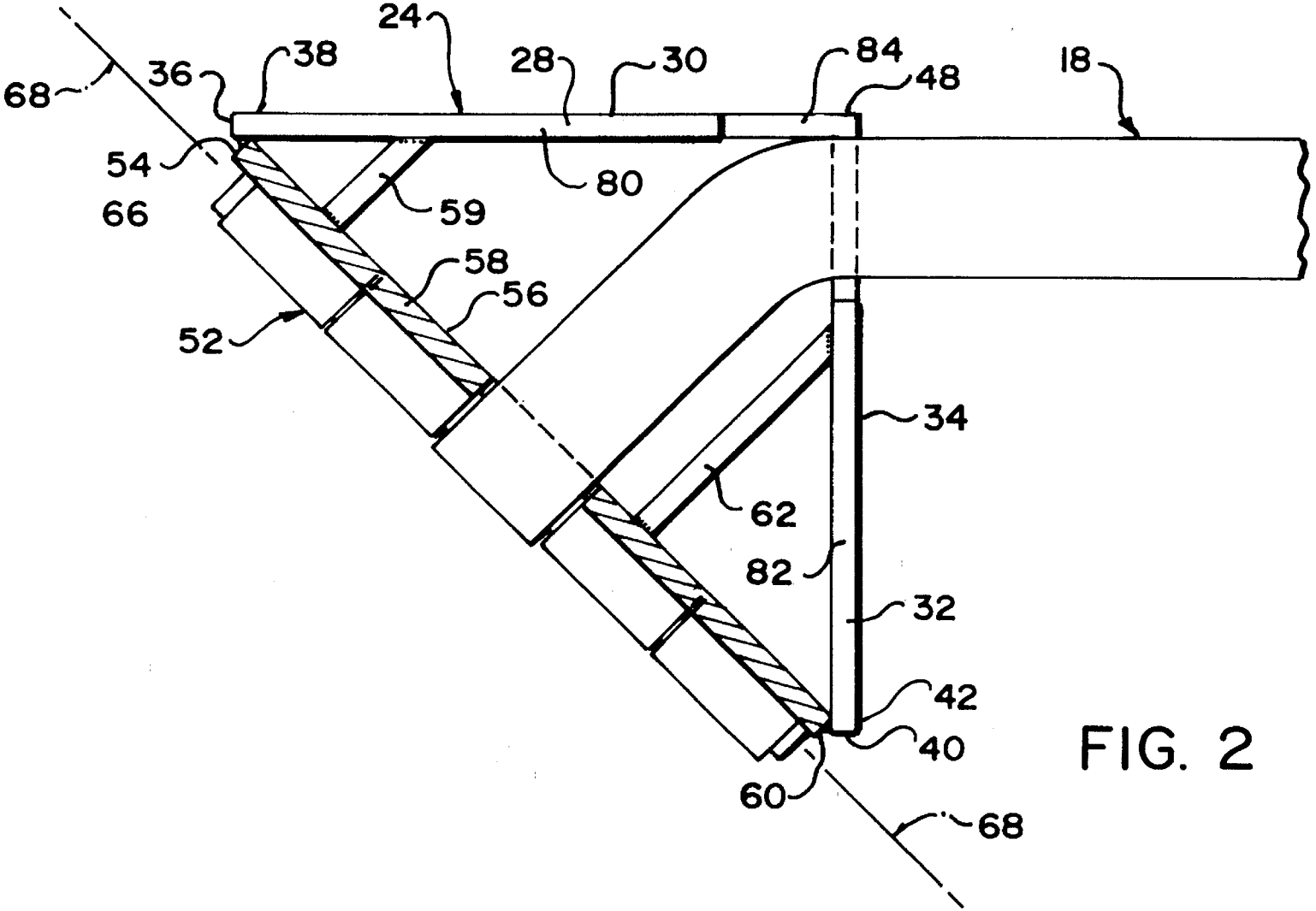
FIG. 2 is a cross sectional view taken along the line 2—2 of FIG. 1.
Figure 3:
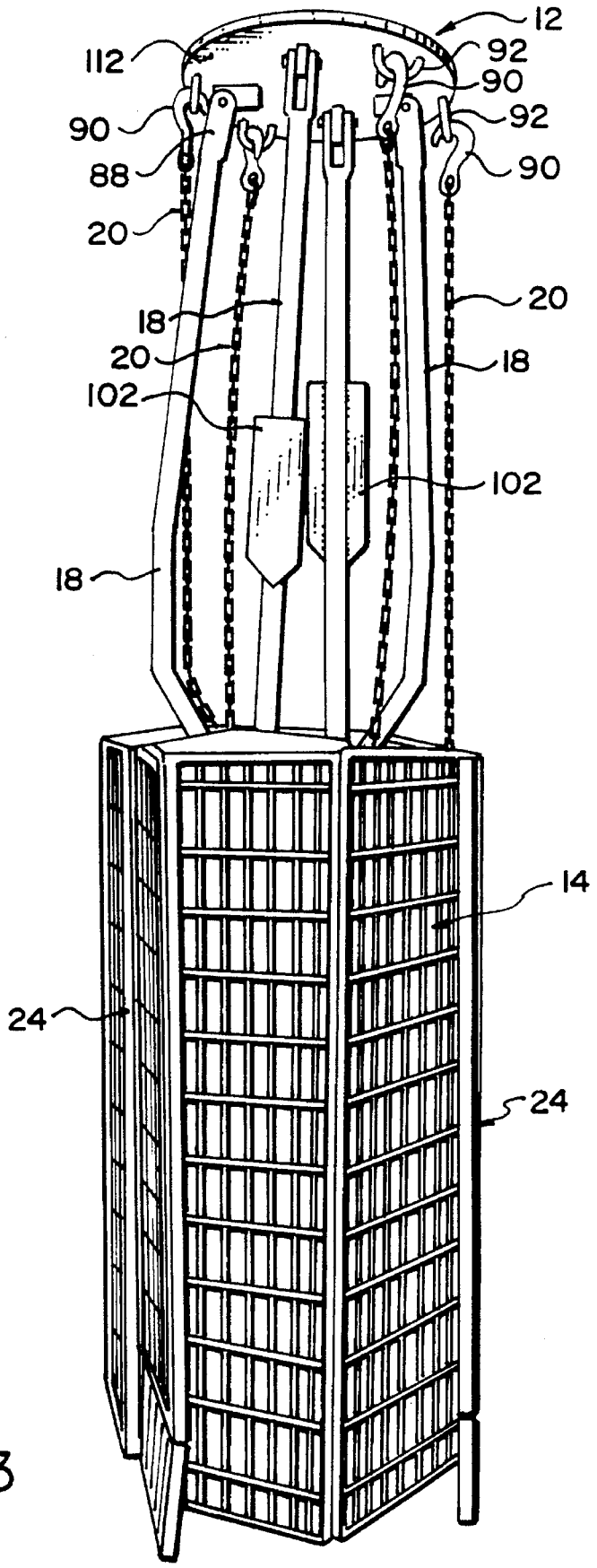
FIG. 3 is an isometric view of the scaffold in the folded vertical position.

As shown in FIGS. 1, 2 and 3 the articulated frame 16 comprises eight bar portions 24 arranged into a rectangle with two bars defining each of the sides 26 of the rectangle. Each bar 24 is formed from angle iron and is arranged with one flange 28 of the angle iron lying in the horizontal plane with its face 30 presented upwards and the other flange 32 lying in the vertical plane with its face 34 presented inwards towards the center of the rectangle. The horizontal flange 28 projects outwards away from the center of the rectangle terminating at a free edge 36 at its end 38 and the vertical flange 32 projects downwards terminating at a free edge 40 at its bottom 42, the space between these two edges defines an open rear face of the bar. Each bar 24 has two open ends 44 and 46, one end 44 at right angles relative to the length of the bar, the other end 46 angled at 45 degrees relative to the length of the bar, said angle starting at the inner edge 48 of the horizontal flange 28 and extending outwards to the outer free edge 36 of the flange 28.

Figure 7:
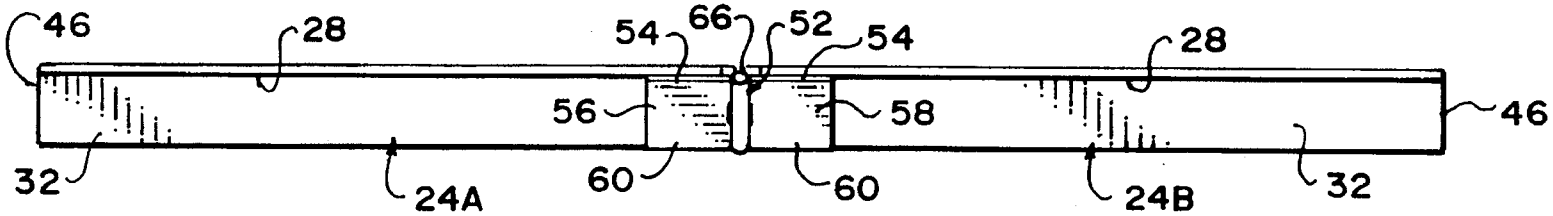
FIG. 7 side view of one side of the articulated frame.

Referring to FIGS. 1, 2 and 7 each side 26 of the articulated frame 16 comprises a pair of the bars 24 which are pivotally connected to one another at their respective right angled ends 44 thereby forming a side 26 of the rectangle with a joint at its midpoint 50. The pivot connection at each of the midpoints 50 is defined by a hinge 52 inclined across the open rear faces of the bars. Each respective hinge plate 56 and 58 is fixed to a flange 59 near its top edge 54. The flange 59 is fixed to each respective bar **24*a* and 24*b* near the free edge 36 of the horizontal flange 28. Each respective hinge plate 56 and 58 is fixed to a flange 62 near its bottom edge 60. The flange 62 is fixed to each respective bar 24*a* and 24*b* near the bottom free edge 40 of the vertical flange 32. The hinge pin 66 lies in an angled plane such that pivotal movement can occur about an axis 68** lying in a vertical plane containing the arms 18 and at 45 degrees to the horizontal.

Figure 4:
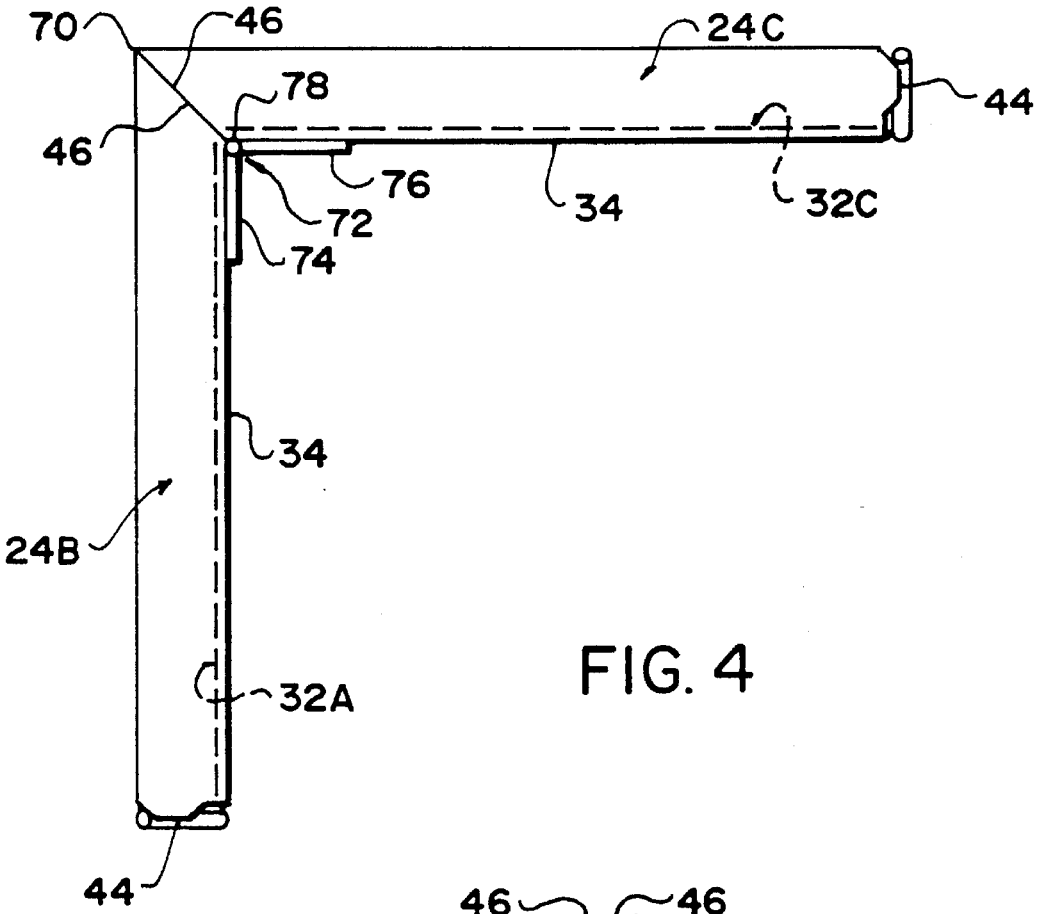
FIG. 4 is a top view of one corner of the articulated frame.
Figure 5:
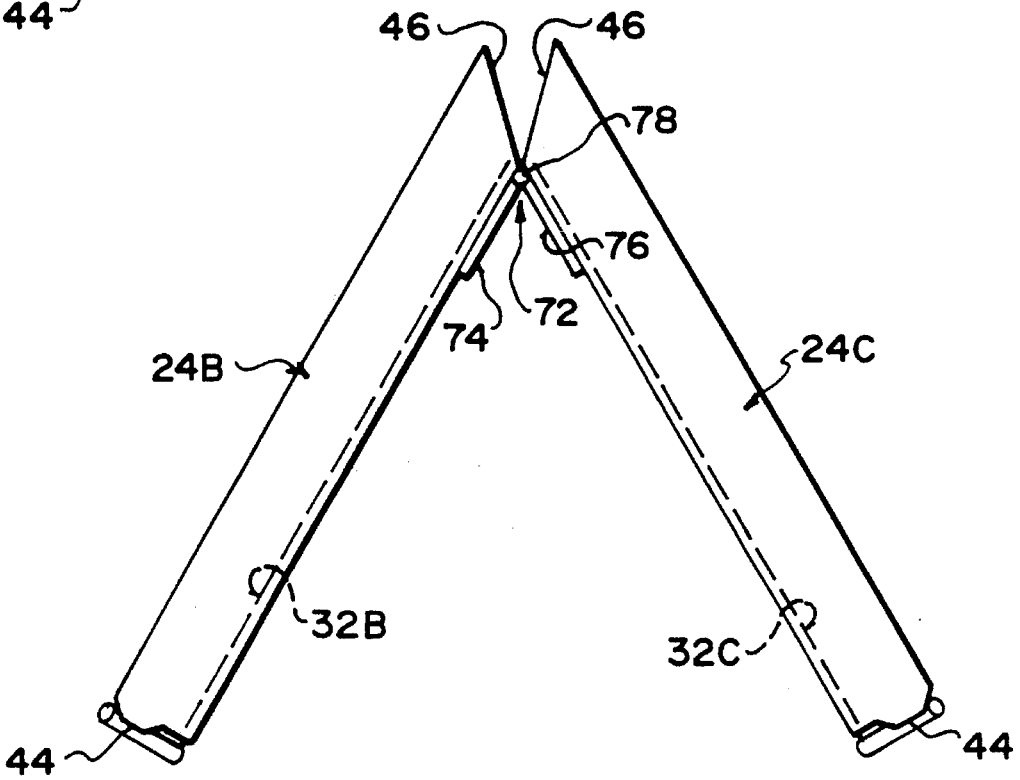
FIG. 5 is a top view of one corner of the articulated frame with the joint open.
Figure 6:
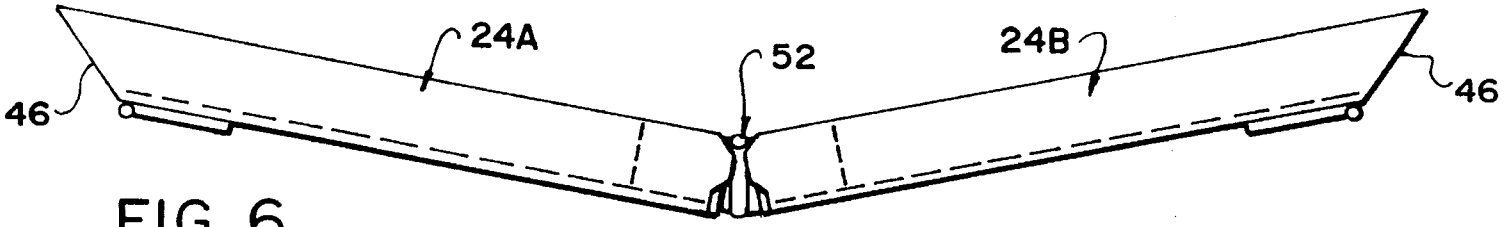
FIG. 6 is a top view of one side of the articulated frame with the joint open.

Referring to FIGS. 1, 4 and 5 the sides 26 are arranged such that four corners 70 are formed by connecting the angled ends 46 of the sides 26 together using pivot connection means in the form of a corner hinge 72. The corner hinge 72 is fixed on the inner faces 34 of the vertical flanges 32 of the respective pair of sides. The corner hinge 72 is arranged such that one hinge plate 74 is fixed to the face of the vertical flange 32*b* at the angled end 46 of a bar 24*b* on one respective side, a second hinge plate 76 is fixed to the vertical face 32*c* of the angled end 46 of one bar 24*c* on the other respective side. The corner hinge pin 78 is oriented to allow pivotal movement about the vertical axis.

Referring to FIGS. 1 and 2 the arrangement of the angle iron bars 24 is such that the sides 26 are held in the generally horizontal position by engagement of the respective edge surfaces 80 and 82 of adjacent angle iron bars with one another. Thus the midpoint 50 and corners 70 are prevented from hinging downwards past the horizontal position by the edges 80 and 82 at the ends 44 and 46 of the adjacent vertical 32 and horizontal 28 flanges coming into contact with each other.

An opening 84 is defined at the joint of the horizontal and vertical flanges at each of the midpoints 50. One of the arms 18 extends through the opening and wraps around the hinge pin 66 of the hinges 52 at the midpoints 50 of each side. The arms 18 extend from each midpoint hinge 52 to the centrally located attachment plate 12 to which they are fixed by a pivot coupling 88 as shown in FIG. 1.

A chain 20 is fixed at one end to one of the bars 24 at each of the corners 70. The chain 20 has a hook 90 at the other end for engaging the opening of a hopper when in use or for engaging the loops 92 on the attachment plate when being stored.

Scaffold flooring 14 is provided for supporting the operator on the scaffold and extends from the outer end 38 of the horizontal flange 28 of the bars 24 inwards to the attachment plate 12. The scaffold flooring 14 comprises flooring sections made up of a plurality of individual flooring segments pivotally connected such that the flooring may be folded up upon itself for storage and unfolded to cover the area defined by a periphery formed by the articulating frame 16. There are four scaffold flooring segments 94, 96, 98 and 100 for covering one quadrant of the articulating frame 16. When in the folded position all the segments 94, 96, 98 and 100 lie along an adjacent bar 24 of the articulated frame 16. When in the unfolded position they are supported on two sides by the top surfaces 30 of the horizontal flanges 28 on the adjacent side bars 24 of the articulated frame 16 and is supported on the another side by generally horizontal fins 102 on the arms 18 such that they cover the area lying therebetween.

The attachment plate 12 is located centrally within the rectangle for attachment to a crane for lifting and lowering the expandable scaffold. The attachment plate 12 has a substantially flat plate oriented 104 generally in the horizontal plane having an inverted U member 106 for engaging hooking means on a crane or hoist on its top side 108. A pin arrangement 88 allowing rotation about a horizontal axis is fixed to the bottom of the plate 112 for fixing the arms 18 pivotally to the plate. Loops 92 are fixed to the plate spaced around the periphery for receiving the hooks at the ends of the chains. The pin arrangements 88 and loops 92 are spaced around the periphery of the plate at intervals of 90 degrees.

Figure 8:
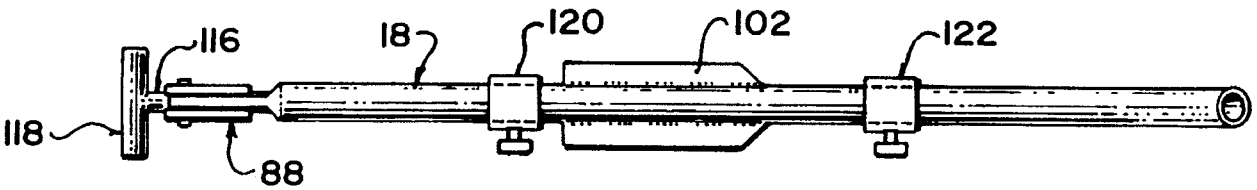
FIG. 8 is a top view of the arm and lateral securing means.
Figure 9:
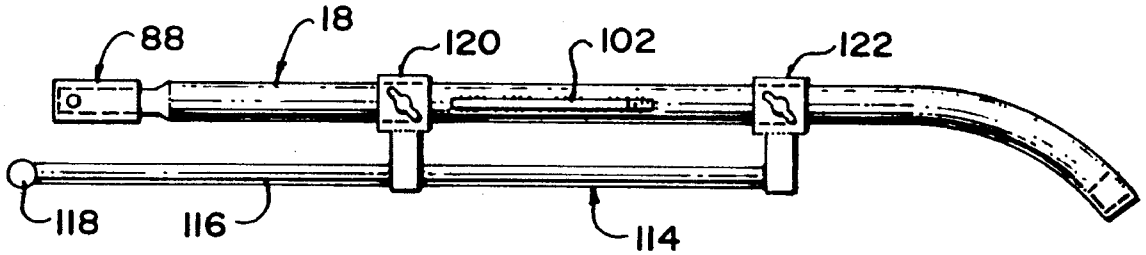
FIG. 9 is a side view of the arm and lateral securing means.

Referring to FIGS. 1, 8, and 9 lateral stabilizing members 114 are located attached to each of the arms 18 in order to stabilize the unit relative to the walls of the hopper. The lateral securing members 114 comprise an elongate bar 116 with a stopper member 118 at one end for engaging a wall. A pair of vertical members 120 and 122 with slidable connection means connect the elongate bars 116 to the elongate arms 18 and space them therefrom. When the scaffold is in the horizontal position the vertical members 120 and 122 project downwards and the elongate bars 116 lie generally horizontally with the stoppers 118 positioned outwards. The elongate bars may be slidably positioned to pass under the articulated frame 16 with the stoppers 118 positioned to engage the walls thus stabilizing the scaffold within the hopper. A fold out type of lateral securing member may also be used.

In use a crane or hoist is attached to the U member 106 on the attachment plate 12. The scaffold is lowered using the crane through the narrow opening in the hopper with the articulated frame 16 folded in its vertical position as shown in FIG. 3. The hooks 90 at the end of the chains 20 are attached to the lip around the opening of the hopper. The scaffold 10 is then lowered through the opening and into place. The chains 20 hold the corners 70 of the articulated frame 16 in place at a fixed depth inside the hopper as the attachment plate 12 and scaffold 10 are lowered. When the chains 20 become taught the midpoints 50 of the sides, attachment plate 12 and arms 18 move downwards relative to the corners 70. As the sides 26 move downwards under their own weight the midpoints 50 pivot downwards outwards opening the scaffold 10 into its horizontal position as shown in FIG. 1. The scaffold 10 is then supported on the chains 20 at the opening in the hopper. The crane and hoist is disconnected from the attachment plate 12 and the scaffold flooring 14 is unfolded and located in place.

When removing the expandable scaffold 10 from a hopper the scaffold flooring 14 is first folded up into its stored position on top of one of the bars 24. A crane or hoist is attached to the U member 106 on the attachment plate 12. The scaffold 10 is then lifted by the attachment plate 12 thus lifting the arms 18 which in turn pull upwards and inwards on the midpoint hinges 52 such that the sides 26 are drawn inwardly at their midpoints 50 towards the center of the rectangle. As the arms 18 and midpoints 50 are lifted by the attachment plate 12 the corners 70 of the scaffold 10 drop downwards relative to the midpoint 50 of the sides 26 and pivot inwards causing the scaffold 10 to fold into its vertical position. As the scaffold is lifted tension in the chains 20 is relieved thereby freeing the chains so that they can be removed from the lip of the opening. The chains 20-are hooked onto the loops 92 on the attachment plate 12 for storage and the scaffold 10 is lifted clear of the hopper opening.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An expandable scaffold of the type for use with a hopper having a narrow opening in the top and which opens out into a larger area inside wherein the scaffold comprises:

attachment means for attaching the scaffold at a top end to a hoist or crane or the like for raising and lowering the scaffold;

an articulated frame including a plurality of bars joined together by a first pivot connection means such that pivoting of the bars may occur about a vertical axis, and by a second pivot connection means such that pivoting of the bars may occur about an axis inclined between the vertical and horizontal axes, wherein the articulated frame may be oriented in a first position such that the bars are arranged in a vertical orientation and a second position such that the bars are arranged in a horizontal position;

folding means connected to the attachment means at one end and to the second pivot connection means on the articulated frame at an other end arranged such that the folding means when actuated move the articulated frame between the first and second positions;

scaffold flooring mounted on the articulated frame for supporting an individual;

a plurality of suspension means each being removably and reengagebly connected at one end to the narrow opening of the vessel and each being connected at the other end near one of the first pivot connection means on the articulated frame.

2. The scaffold according to claim 1 wherein the articulated frame comprises eight bars arranged in four pairs such that each pair of bars is joined together at adjacent ends by second pivoting means and that each pair is joined to another pair at its free ends by first pivoting means.

3. The scaffold according to claim 2 wherein the bars comprise angle iron sections each having a horizontal and a vertical flange such that when the scaffold is in the second position the bars are arranged with a horizontal face oriented upwards and a vertical face oriented inwards towards a center.

4. The scaffold according to claim 3 wherein the bars when the scaffold is in the second position are arranged to form a generally square periphery.

5. The scaffold according to claim 3 wherein edges of the horizontal and vertical flanges engage each other when the scaffold is in the second position thereby preventing downward movement past the second position.

6. The scaffold according to claim 1 wherein the attachment means comprise a substantially flat attachment plate oriented generally in the horizontal plane having a releasable and reengageable connection means on a top side, pivot connection means on a bottom side, and loops for receiving hooks spaced around the periphery.

7. The scaffold according to claim 6 wherein the releasable and reengageable connection means comprise an inverted U member for engaging a hooking means on a crane or hoist or the like.

8. The scaffold according to claim 6 wherein the pivot connection means comprise a pin arrangement for rotation about a horizontal axis.

9. The scaffold according to claim 6 wherein the pivot connection means are spaced around the periphery of the plate at intervals of 90 degrees.

10. The scaffold according to claim 3 wherein the first pivot connection means comprise a hinge fixed to an outer free edge of the horizontal face and a bottom free edge of the vertical face, arranged such that one hinge plate is fixed near its top edge to a first bar and a second hinge plate is fixed near its top to a second bar, and a hinge pin is oriented to allow pivot movement about an axis lying between the vertical and horizontal planes and such that a top of each hinge plate is fixed to a bottom surface near an outside free edge of the horizontal flange and a bottom of each hinge plate is fixed to an outside surface near the bottom of the vertical flange.

11. The scaffold according to claim 10 wherein the axis lying between the vertical and horizontal planes is at 45 degrees to the horizontal flange.

12. The scaffold according to claim 3 wherein the second pivot connection means comprise a hinge fixed on an inner vertical face of the vertical flange of one free end on each of a pair of bars, arranged such that one hinge plate is fixed to the vertical face of one pair of bars, a second hinge plate is fixed to the vertical face of a second pair of bars, and a hinge pin is oriented to allow pivotal movement about a vertical axis when the articulated frame is in the second position.

13. The scaffold according to claim 1 wherein each suspension means comprise a chain having a hook at one end and being fixed to the articulated frame near one of the first pivotal connection means at another end.

14. The scaffold according to claim 8 wherein the folding means comprise elongate arm members.

15. The scaffold according to claim 14 wherein the elongate arm members comprise an elongate member having fixed at one of its ends a member for engaging one of the pin arrangements on the attachment plate, a bend at the end opposite, and at the end with the bend a hollow cylindrical member for engaging around the hinge pin of one of the second pivot connection means.

16. The scaffold according to claim 15 wherein the elongate arm members include a pair of support members fixed to opposing sides of the arm which lie generally horizontally when the scaffold is in the second position.

17. The scaffold according to claim 15 including lateral securing means comprising an elongate bar having a stopper member at one end for engaging the a wall, a pair of vertical members having slidable connection means for connecting the elongate bar to the elongate arms and spacing it therefrom, such that when the scaffold is in the second position the vertical members project downwards and the elongate bar lies generally horizontally with the stopper positioned outwards such that the elongate bar may be slidably positioned to pass under the articulated frame with the stopper end positioned to contact a wall.

18. The scaffold according to claim 3 wherein the scaffold flooring extends from the outer edge of the horizontal bars inwards to the center of the scaffold.

19. The scaffold according to claim 18 wherein scaffold flooring comprises a plurality of individual flooring sections pivotally connected such that the flooring may be folded up upon itself and unfolded to cover an area defined by a periphery formed by the articulating frame.

20. The scaffold according to claim 18 wherein the folding means include a pair of support members fixed to opposing sides of the folding means which lie generally horizontally when the scaffold is in the second position, and wherein there are four scaffold flooring sections each one being fixed on one edge to an outer edge of the articulated frame for covering one quadrant of the articulating frame, such that when in the folded position each section lies along an adjacent bar of the articulated frame and when in the unfolded position it is supported on two sides by the bars of the articulated frame and the other two sides by the support members on the arms covering the area therebetween.

* * * * *